US006103396A

United States Patent [19]

Das et al.

[11] Patent Number: 6,103,396

[45] Date of Patent: Aug. 15, 2000

[54] THICK AMORPHOUS METAL STRIP HAVING IMPROVED DUCTILITY AND MAGNETIC PROPERTIES

[75] Inventors: Santosh K. Das, Randolph; Richard L. Bye; Jeng S. Lin, both of Morristown, all of N.J.

[73] Assignee: AlliedSignal Inc., Morris Township, N.J.

[21] Appl. No.: 08/920,717

[22] Filed: Aug. 29, 1997

Related U.S. Application Data

[63] Continuation-in-part of application No. 08/699,743, Aug. 20, 1996, abandoned.

[51] Int. Cl.[7] ..... C21D 8/12; B22D 11/06; H01F 1/153

[52] U.S. Cl. ..... 428/611; 428/457; 428/606; 428/615; 148/300; 148/306; 148/404

[58] Field of Search ..... 164/463; 428/611, 428/606, 615, 457; 148/300, 306, 404

[56] References Cited

U.S. PATENT DOCUMENTS

| | | | |
|---|---|---|---|
| 3,856,513 | 12/1974 | Chen et al. | 75/122 |
| 3,862,658 | 1/1975 | Bedell | 164/87 |
| 4,142,571 | 3/1979 | Narasimhan | 164/88 |
| 4,332,848 | 6/1982 | Narasimhan | 428/174 |
| 4,337,087 | 6/1982 | Esashi et al. | 75/124 |
| 4,588,015 | 5/1986 | Liebermann | 164/463 |
| 4,782,994 | 11/1988 | Raybould et al. | 228/235 |
| 4,865,644 | 9/1989 | Charles | 75/84.5 |
| 4,865,664 | 9/1989 | Sato et al. | 148/403 |
| 5,301,742 | 4/1994 | Sato et al. | 164/463 |
| 5,456,308 | 10/1995 | Yukumoto et al. | 164/463 |
| 5,496,418 | 3/1996 | Ramanan et al. | 148/304 |

FOREIGN PATENT DOCUMENTS

| | | |
|---|---|---|
| 0 035 037 | 9/1981 | European Pat. Off. . |
| 0 058 269 | 8/1982 | European Pat. Off. . |
| 0 611 138 A1 | 8/1994 | European Pat. Off. . |
| 60 177936 | 9/1985 | Japan . |
| 06 269907 | 9/1994 | Japan . |

OTHER PUBLICATIONS

EPRI Report EPRI TR–101978, Apr. 1993.
English Abstracts 06 269907.
English Abstracts 60 177936.
PCT Search Report.

*Primary Examiner*—Archene Turner
*Attorney, Agent, or Firm*—Charlotte H. Copperthite; John A. Squires

[57] ABSTRACT

An amorphous metal strip having a sheet thickness ranging from about 50 to 75 μm and a sheet width of at least 20 mm is produced by a casting process utilizing a single nozzle orifice and a high thermal conductivity, large diameter wheel as a casting substrate. The strip has a fracture strain of 0.01 or more, a lamination factor of 0.8 or more, and a core loss of less than 0.2 W/kg at 60 Hz and 1.4 T.

8 Claims, 3 Drawing Sheets

THICK AMORPHOUS METAL STRIP HAVING IMPROVED DUCTILITY AND MAGNETIC PROPERTIES

CROSS REFERENCE TO RELATED APPLICATIONS

This application is a continuation-in-part of U.S. application Ser. No. 08/699,743, filed Aug. 20, 1996, now abandoned.

BACKGROUND OF THE INVENTION

1. Field Of The Invention

This invention relates to amorphous metal strips having a large thickness with good magnetic properties and a method for producing the same, and more particularly to amorphous metal strips having a large thickness produced by a melt spin process wherein a stream of molten metal is quenched and solidified on the peripheral surface of a rotating annular chill roll.

2. Description Of The Prior Art

Iron based alloys that are rapidly solidified to thin strip with an amorphous microstructure are known to have interesting soft magnetic properties, making them attractive as highly efficient cores for electric transformers. The casting of strip having an amorphous structure requires cooling rates of $10^{6°}$ C./sec to avoid crystallization and deterioration in the desired magnetic properties, this limits the thickness of the strip. The composition of iron based alloys and the required casting conditions are described in detail in U.S. Pat. Nos. 3,856,513, 3,862,658 and 4,332,848. U.S. Pat. No. 5,496,418 discloses rapid solidification casting of amorphous metal strips, the thickness of which is limited to 25 μm. Amorphous metal strips are produced on a commercial scale by AlliedSignal Inc. and marketed under the METGLAS® trademark. The strips are produced by the Planar Flow Casting process described in U.S. Pat. No. 4,142,571 and have a thickness of approximately 25 micrometers (μm). At this thickness the alloys find uses predominantly in low power wound core distribution transformers. Strip ductility, or the ability to handle strip in the transformer core making process, is the primary factor limiting the thickness. Thicker strip is required for higher power stacked core transformers.

The thinness of the amorphous strip makes handling difficult in comparison to the thicker FeSi sheet that is currently used for transformer laminations in stacked core transformers. Specifically, when the thin amorphous metal strip is stacked into a transformer the extra laminations required to fill the same space increase production costs. In addition, the increased number of air gaps between laminations decreases the packing density, commonly referred to as lamination factor or space factor, reducing the transformers' efficiency. Accordingly, there is a need for thicker amorphous metal strip with low magnetization losses and exciting power. The thicker strip must be ductile enough to be handled during manufacture of transformer cores.

Considerable research has focused on the Planar Flow Casting process to produce thicker strip. In this process, the alloy melt is delivered through a slotted nozzle into a stable puddle maintained between the slot lips and a moving substrate. This stable puddle is the unique feature of the process. All process parameters for a given casting apparatus are adjusted to preserve stability. These parameters are: nozzle slot width, nozzle-to-substrate distance ("casting gap"), melt ejection ("casting") pressure, and substrate speed, all of which, in concert, control the puddle length.

This length, limits the time available for the solidification of the glassy strip and, therefore, governs the strip thickness. While it may seem apparent that changing one of these parameters to increase melt flow rate would increase the strip thickness, the dynamics of the process are such that the puddle integrity could be seriously compromised. Strip with poor surface quality is the result; at the extreme, the puddle "blows out".

Surface quality impacts the practical application of amorphous metal strips in multiple layer configurations such as transformer cores by its effect on packing density. The rougher the strip, that is, the more the local strip thickness varies along its width and length, the greater the volume that is filled with a given number of layered strips. The cost of devices such as transformers which utilize cores made from multiple layers of amorphous alloy strip is strongly related to the physical size of the cores.

The packing density of amorphous metal strip, also referred to as lamination factor, stack factor or space factor, is described by the quantity equal to the weight density of a stack of amorphous metal strips divided by the weight density of the strip material comprising the stack. A high lamination factor, preferably greater than about 0.80, is desirable for use of amorphous metal alloys in transformers as it allows a physically smaller core to be constructed for a given performance level.

It is well known that the mechanical properties of an amorphous metal strip depend on the sheet thickness. As strip thickness increases, the heat that must be extracted in order to solidify it increases, thereby decreasing the cooling rate. This decrease in cooling rate is accompanied by a decrease in strip ductility and handleability. A common measure of strip ductility is fracture strain. Fracture strain, $\epsilon_f$, is usually represented by the expression $\epsilon_f = t/(2r-t)$, wherein t is the strip thickness and r is the bending radius at which fracture occurs. In general, a high fracture strain is desirable; for practical use of amorphous metal strip the fracture strain should be greater than 0.01.

Magnetic properties of amorphous alloy strips are also known to depend on thickness. Amorphous metal strip typically requires an annealing treatment to optimize magnetic properties such as core loss and exciting power for transformer applications. The specific annealing conditions may vary depending on factors such as specific alloy composition, strip configuration, and transformer design considerations, but typically involves heating the strip to between 350° C. and 400° C. for between 60 minutes and 180 minutes. In general, core loss is not strongly affected by an increase in thickness as long as it remains substantially amorphous. As thickness increases, however, the cooling rate decreases until a critical value is reached at which substantial crystallinity is formed. At that point, losses begin to increase rapidly with thickness.

Earlier attempts to produce thick strip involved using a belt as a quench substrate [Electric Power Research Institute Report, EPRI TR-101978, April 1993]. Belt casting trials to produce thick strip failed because of a lack of ductility in the as-cast strip. The thick, amorphous strips were otherwise magnetically acceptable. In this study, a moving belt was used as the substrate, which was cooled by a water spray. A major reason for the employment of a belt as the quench substrate was that a belt approximates a "wheel" of infinite diameter, so that low substrate return temperatures could be maintained even when casting a thick strip. However, deficiencies in the heat extraction ability of the apparatus and belt distortion were the primary reasons for failure to produce thick ductile strip.

Other efforts have been made to develop techniques that increase the thickness of the strip, while maintaining an amorphous structure. One such technique is described in U.S. Pat. No. 4,782,994, in which strips are bonded together. Although bonding of thin strips maintains reasonable magnetic properties, such bonded strips are inherently brittle.

U.S. Pat. No. 4,865,664 and U.S. Pat. No. 5,301,742 disclose processes in which thicker (to 100 μm) amorphous metal strip is cast via the use of a nozzle having a plurality of slotted openings spaced slightly apart from each other. The methods disclosed therein involve a cumbersome process of drawing out a molten metal on the moving chill substrate through a first molten metal puddle portion to make a first strip; drawing out a second molten metal over the first strip in a not completely solidified state through a second molten metal puddle portion so as to make a second strip; and drawing out subsequent molten metals through further portions so as to make subsequent strips until the required sheet thickness is obtained. Use of this method is said to produce an amorphous metal strip greater than 50 μm thick having a room temperature fracture strain greater than 0.01, a lamination factor greater than 0.85 and good magnetic properties. U.S. Pat. No. 4,865,644 and U.S. Pat. No. 5,301,742 disclose further that amorphous metal strips having a large thickness with similarly good properties can not be produced using a single slotted nozzle.

It would be advantageous if amorphous metal strips having large thickness and good structural and magnetic properties could be produced on a single roll casting apparatus using a single slotted nozzle. Such a product and the process for producing it would be highly desirable, especially for the production of wide strip, owing to the ease of manufacture and robustness relative to processes wherein the nozzle has multiple slots.

There remains a need in the electric transformer art for thicker amorphous strip having physical properties, including ductility and lamination factor, adequate for the manufacturing of transformer cores and having magnetic properties after annealing similar to those of 25 μm thick amorphous strip presently in use.

SUMMARY OF THE INVENTION

The present invention provides an amorphous alloy strip having large thickness and width.

Another objective of the present invention is to provide an iron based alloy strip having large thickness and width and having improved ductility, particularly, bending fracture strain.

A further objective of the present invention is to provide a ferromagnetic amorphous alloy strip having large thickness and width and having good magnetic properties.

A further objective of the present invention is to provide a ferromagnetic amorphous alloy strip having large thickness and width and having a high lamination factor.

A further objective of the present invention is to provide a method for producing an amorphous metal strip having a large sheet thickness and width and having improved properties.

According to the present invention, there is provided an amorphous alloy strip having a sheet thickness of from 50 μm to 75 μm, a sheet width of at least 20 mm and a fracture strain of at least about 0.01. The strip is produced by a single-roll cooling process wherein molten alloy is ejected from a nozzle onto a rapidly moving quench substrate. The nozzle has provided therein a single orifice through which the molten alloy is ejected. The quench substrate comprises a wheel having a diameter greater than 0.5 m, and has a thermal conductivity greater than 0.5 cal/cm sec ° C.

It has been found that when molten metal is ejected from a nozzle containing a single slotted orifice onto the rapidly moving surface of a quench substrate meeting thermal conductivity and geometric dimensions specified above, the amorphous alloy strip produced exhibits excellent mechanical and magnetic properties. Specifically, such strip has good ductility, particularly, a fracture strain of 0.01 or more. Iron based amorphous alloy strip produced in this manner exhibits good magnetic properties, particularly, core loss of less than 0.2 W/kg at 60 Hz and 1.4 T.

There is further provided a method for producing an amorphous alloy strip by ejecting a molten alloy through a nozzle with a single slotted orifice onto the surface of a rotating annular quench substrate, wherein the quench substrate has a thermal conductivity higher than 0.50 cal/cm sec ° C.; and the quench substrate is a wheel, the diameter of which is greater than 0.5 m.

BRIEF DESCRIPTION OF THE DRAWINGS

The invention will be more fully understood and further advantages will become apparent when reference is made to the following detailed description of the preferred embodiments of the invention and the accompanying drawings, in which.

DESCRIPTION OF THE PREFERRED EMBODIMENTS

Figure 1:
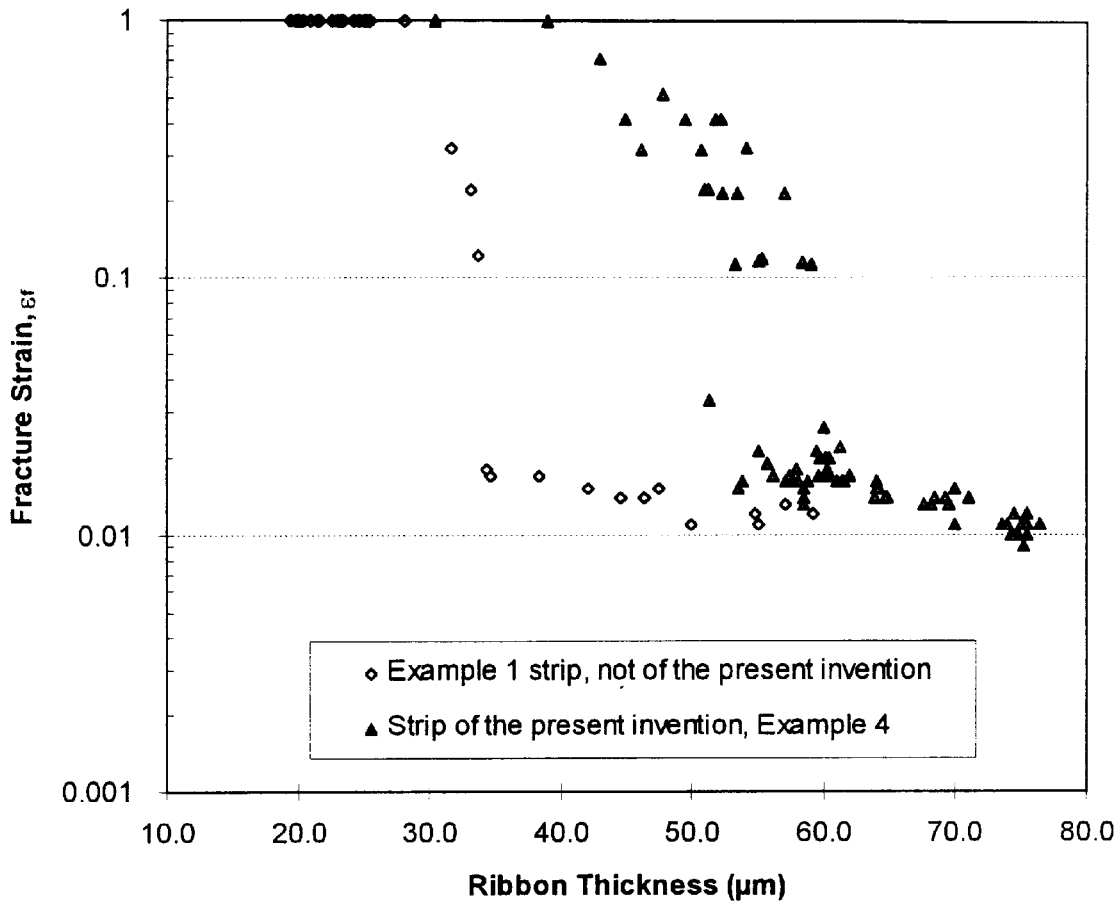
FIG. 1 is a graph showing strip fracture strain as a function of strip thickness for conventionally processed strip and for strip processed in accordance with the present invention.

The amorphous metal strip of the present invention is produced via the Planar Flow Casting Process in which molten metal is forced through a nozzle containing a single slotted orifice into the annular space between the exit of the nozzle slot and a "single roll" rapidly moving chilled casting substrate. A stable puddle is thereby formed in said annular space from which a strip of solidified amorphous alloy, with width substantially equal to the slot length, is extracted by the casting substrate as it moves. Strip thickness is dependent upon casting pressure, nozzle slot width and casting substrate velocity.

According to the present invention, there is used a casting pressure, that is, a pressure acting on the molten metal to force it out through the nozzle orifice. Such casting pressure is greater than the ambient pressure and, preferably ranges from about 18 kPa to 32 kPa greater than ambient.

In practice of the present invention, it is preferable that the molten metal puddle contained in the annular space between the casting substrate and the casting nozzle be shielded with an atmosphere of inert or reducing gas.

The nozzle orifice should be sized so that its length (I) is substantially the same as the desired strip width. Its width (w) should be between 0.4 mm and 1.3 mm, and preferably between 0.6 mm and 1.0 mm.

Given the above constraints, the substrate speed and the gap between the nozzle and the substrate are chosen so as to produce a desired strip thickness. In the present invention, casting speed should be between about 12 m/sec and 25 m/sec and preferably between 15 and 21 m/sec. The nozzle/substrate gap should be less than 0.6 mm and preferably less than 0.4 mm.

The strip of the present invention is cast on a chilled quench substrate made from a material with a room temperature thermal conductivity as high as possible, and preferably made from a copper alloy with a room temperature thermal conductivity greater than about 0.5 cal/cm sec ° C. The chilled quench substrate should have a circumference equivalent to that of a cylinder with a diameter greater than 0.5 m, preferably between 0.6 m and 1.0 m. Although high thermal conductivity and large diameter are desirable, engineering and operational limitations limit the maximums that may be practically employed.

The strip has a width greater than 25 mm and a thickness greater than 50 μm and is substantially amorphous. Iron based, amorphous strip produced in accordance with the invention has a high fracture strain, preferably greater than 0.01 at room temperature, a lamination factor preferably greater than 0.80 and good magnetic properties after annealing, with room temperature core loss at 60 Hz, 1.4 T preferably being less than 0.2 W/kg. From the physical, mechanical and magnetic properties of the strips of the present invention, it is apparent that the combination of a large diameter cooling substrate and a substrate material having a high room temperature thermal conductivity increases the metal cooling rate sufficiently to allow thick strip capable of practical use to be produced using a nozzle with a single orifice.

For example, the increase in fracture strain for a given strip thickness or, equivalently, the increase in strip thickness for a given fracture strain that is achieved through the practice of the present invention is demonstrated in FIG. 1, in which average fracture strain for conventionally processed strip and for strips of this invention is plotted against strip thickness. Fracture strains greater than 0.01 were achieved in strip having thickness up to 75 μm when cast on a large diameter, high conductivity wheel of the present invention.

A large diameter, high conductivity wheel of this invention appears to favorably impact puddle stability, also. This is demonstrated by the achievement of lamination factors of between 0.84 and 0.93 in 76 mm wide strip ranging in thickness between about 60 μm and 73 μm cast by the method of this invention. Prior to this invention, it was thought that high lamination factors could not be produced in strip of this thickness unless the casting nozzle had multiple slots.

Figure 2:
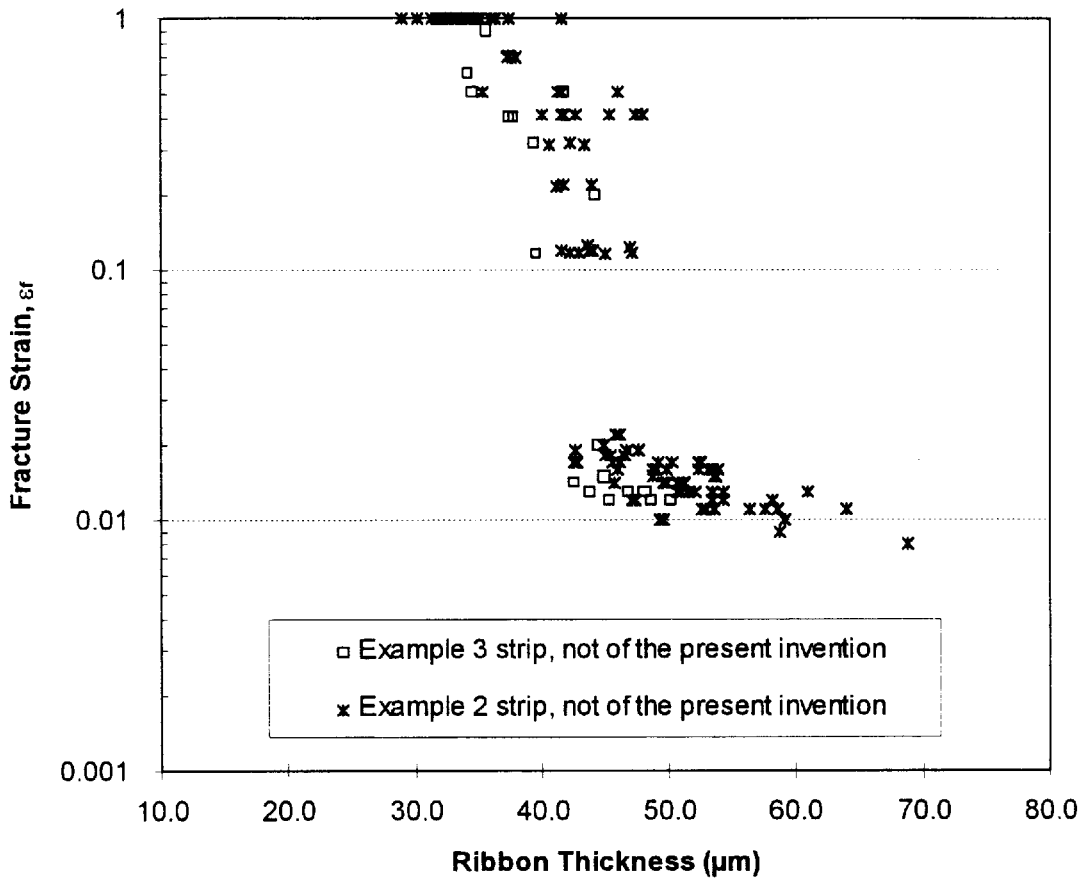
FIG. 2 is a graph showing strip fracture strain as a function of strip thickness for two process modifications which are used in combination in the present invention but which, if used individually instead of collectively, do not produce the benefits of the invention.
Figure 3:
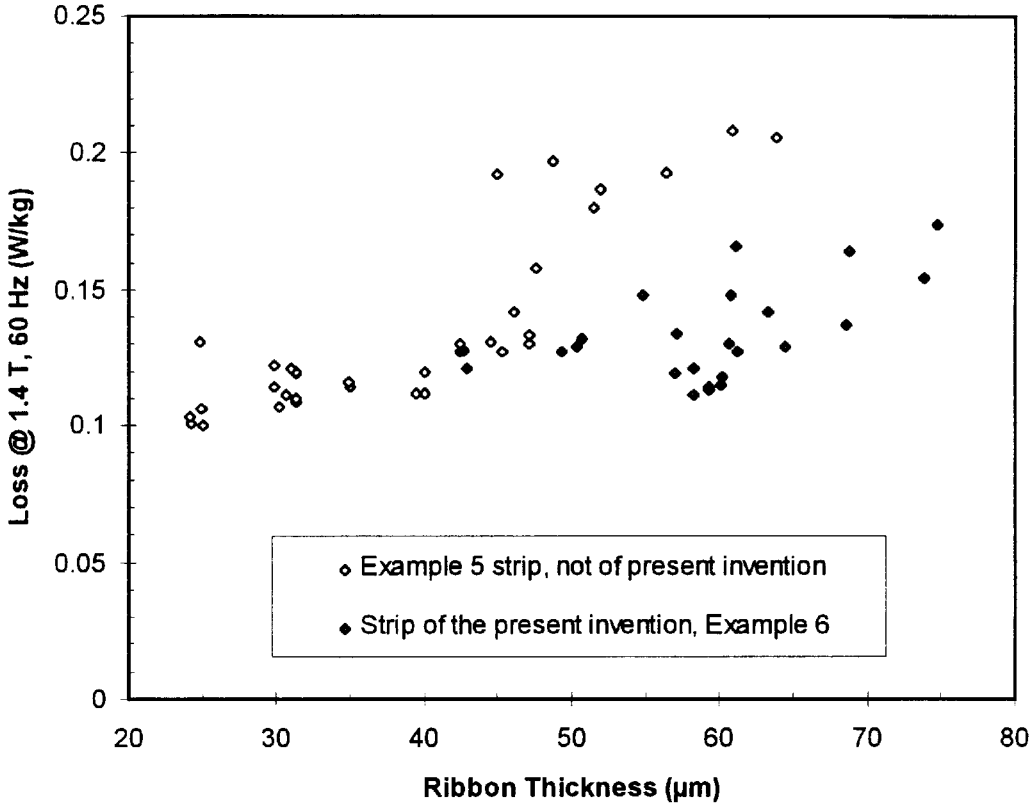
FIG. 3 is a graph showing magnetic properties as a function of strip thickness for strip produced in accordance with the present invention and strip produced using a process outside the scope of the present invention.

We have found that the combination of high casting substrate thermal conductivity and large diameter is necessary to produce the improvements gained with the present invention. This is demonstrated in FIG. 2, in which fracture strain at room temperature for strips cast on a small diameter substrate with high thermal conductivity and for strips cast on a large diameter substrate with low thermal conductivity is plotted against strip thickness. A comparison between FIGS. 1 and 2 shows that the fracture strain of strip cast under these conditions is intermediate to that of conventionally processed strip and strip of this invention. High thermal conductivity in combination with large diameter is required to allow strip to be cast up to 75 μm thick with a room temperature fracture strain greater than 0.01 with a single nozzle slot. That the combination of high thermal conductivity and large diameter is required is further exemplified in FIG. 3, in which core loss, measured at 60 Hz and 1.4 T is plotted for annealed strips cast through a single slot on a small diameter, high conductivity wheel and for annealed strips of this invention. Losses increase rapidly above a thickness of about 45 μm for the strips not of this invention. By way of contrast, strips of the present invention up to 75 μm in thickness retain attractive losses.

EXAMPLE 1

An alloy with a nominal composition of 4.6 wt % Si and 2.75 wt % B, the balance being Fe plus incidental impurities, was cast into strips having a width of 25 mm by Planar Flow Casting using a casting substrate having a diameter of about 0.38 m made from a copper alloy having a room temperature thermal conductivity of about 0.2 cal/cm sec ° C. The substrate velocity was about 20 m/sec. Casting pressures ranging from 12 kPa to 29 kPa, nozzles with single slots having widths ranging from 0.4 mm to 1.3 mm and nozzle/substrate gaps of between 0.13 mm and 0.43 mm were used. Under these conditions, strips ranging in thickness between about 20 μm and 60 μm were produced. The room temperature fracture strain of these strips is plotted against strip thickness in FIG. 1. It can be seen that the fracture strain decreases rapidly as strip thickness increases beyond approximately 30 μm.

These strips are not of the present invention and were cast to demonstrate the limits of conventional processing.

EXAMPLE 2

An alloy having a nominal composition of 4.6 wt % Si and 2.75 wt % B, the balance being Fe plus incidental impurities, was cast into strips having a width of 25 mm by Planar Flow Casting using a casting substrate having a diameter of about 0.38 m made from a copper alloy having a room temperature thermal conductivity of about 0.53 cal/cm sec ° C. The substrate velocity was about 20 m/sec. Casting pressures ranging from 20 kPa to 27 kPa, nozzles with single slots having widths ranging from 0.6 mm to 1.3 mm and nozzle/substrate gaps of between 0.13 mm and 0.5 mm were used. Under these conditions, strips ranging in thickness between about 28 μm and 68 μm were produced. The fracture strain of these strips is plotted against strip thickness in FIG. 2.

These strips are not of the present invention and were cast to demonstrate the limits of casting on a small diameter substrate made from a material with a high thermal conductivity.

EXAMPLE 3

An alloy with a nominal composition of 4.6 wt % Si and 2.75 wt % B, the balance being Fe plus incidental impurities, was cast into strips having a width of 25 mm by Planar Flow Casting using a casting substrate having a diameter of about 0.91 m made from a copper alloy having a room temperature thermal conductivity of about 0.2 cal/cm sec ° C. The substrate velocity was about 20 m/sec. Casting pressures ranging from 23 kPa to 25 kPa, nozzles having a single 0.76 mm wide slot and nozzle/substrate gaps of between 0.15 mm and 0.3 mm were used. Under these conditions, strips ranging in thickness between about 28 μm and 68 μm were produced. The room temperature fracture strain of these strips is plotted against strip thickness in FIG. 2.

These strips are not of the present invention and were cast to demonstrate the limits of casting on a large diameter substrate made from a material with a low thermal conductivity.

EXAMPLE 4

An alloy with a nominal composition of 4.6 wt % Si and 2.75 wt % B, with balance being Fe plus incidental impurities, was cast into strips having a width of 25 mm by Planar Flow Casting using a casting substrate having a diameter of about 0.91 m made from a copper alloy having a room temperature thermal conductivity of about 0.53 cal/cm sec ° C. The substrate velocity used was either about 15 n/sec or about 20 m/sec. Casting pressures ranging from 21 kPa to 24 kPa, nozzles with single slots having a width of either 0.76 mm or 1.3 mm and nozzle/substrate gaps of between 0.18 mm and 0.33 mm were used. Under these conditions, strips ranging in thickness between about 30 μm and 77 μm were produced. The room temperature fracture strain of these strips is plotted against strip thickness in FIG. 1. The fracture strain starts to drop rapidly as the thickness exceeds about 40 μm, but is greater than 0.01 up to a thickness of 75 μm.

EXAMPLE 5

An alloy having a nominal composition of 4.6 wt % Si and 2.75 wt % B, the balance being Fe plus incidental impurities, was cast into strips having a width of 25 mm by Planar Flow Casting using a casting substrate having a diameter of about 0.38 m made from a copper alloy having a room temperature thermal conductivity of about 0.53 cal/cm sec ° C. The substrate velocity was about 20 m/sec. Casting pressures ranging from 20 kPa to 27 kPa, nozzles with single slots having widths ranging from 0.43 mm to 1.3 mm and nozzle/substrate gaps of between 0.13 mm and 0.5 mm were used. Under these conditions, strips ranging in thickness between about 28 μm and 60 μm were produced.

The strips were cut into 30 cm lengths and then annealed under conditions that are representative of standard conditions for conventionally cast strip of this nominal composition. Room temperature core loss measurements were made with a straight strip measurement technique. Losses were found to be only slightly affected by thickness up to a thickness of about 45 μm, above which losses increased rapidly. Room temperature core loss at 60 Hz, 1.4 T for these strips are plotted against strip thickness in FIG. 3.

These strips are not of the present invention and were cast to demonstrate the limits of casting on a small diameter substrate made from a material with a high thermal conductivity.

EXAMPLE 6

An alloy having nominal composition of 4.6 wt % Si and 2.75 wt % B, the balance being Fe plus incidental impurities, was cast into strips having a width of 25 mm by Planar Flow Casting using a casting substrate with a diameter of about 0.91 m made from a copper alloy with a room temperature thermal conductivity of about 0.53 cal/cm sec ° C. The substrate velocity used was either about 15 m/sec or about 20 m/sec. Casting pressures ranging from 21 kPa to 24 kPa, nozzles with single slots having a width of either 0.76 mm or 1.3 mm and nozzle/substrate gaps of between 0.18 mm and 0.33 mm were used. In these casts, strips ranging in thickness between about 42 μm and 77 μm were produced.

The strips were cut into 30 cm lengths and then annealed under conditions that are representative of standard conditions for conventionally cast strip of this nominal composition. Room temperature core loss measurements were made with a straight strip measurement technique. Losses were found up to be affected by thickness only slightly up to 75 μm and no critical thickness above which the losses increased rapidly was found below 75 μm. Room temperature core loss at 60 Hz, 1.4 T for these strips are plotted against strip thickness in FIG. 3. These results clearly demonstrate the benefits of using a large diameter casting substrate made from a material with a high thermal conductivity for Planar Flow Casting with a single slotted casting nozzle.

EXAMPLE 7

An alloy having a nominal composition of 4.6 wt % Si and 2.75 wt % B, the balance being Fe plus incidental impurities, was cast into strips having a width of 76 mm by Planar Flow Casting using a casting substrate with a diameter of about 0.91 m made from a copper alloy having a room temperature thermal conductivity of about 0.53 cal/cm sec ° C. The substrate velocity used was about 15 m/sec. Casting pressures ranging from 21 kPa to 26 kPa, nozzles with single slots having a width of either 0.76 mm or 1.3 mm and nozzle/substrate gaps of between 0.2 mm and 0.3 mm were used. In these casts, strips ranging in thickness between about 60 μm and 74 μm were produced. Each of the strips was subjected to X-ray diffraction analysis and was determined to be completely amorphous within the limits of the X-ray diffraction technique. The lamination factor of these strips is shown in the table below:

TABLE 1

| Strip Number | Strip Thickness | Lamination Factor |
|---|---|---|
| 206-1 | 67 μm | 0.86 |
| 209-1 | 60 μm | 0.84 |
| 218-1 | 72 μm | 0.89 |
| 219-1 | 68 μm | 0.93 |

EXAMPLE 8

An alloy having a nominal composition of 4.6 wt % Si and 2.75 wt % B, the balance being Fe plus incidental impurities, was cast into strips having a width of 76 mm by Planar Flow Casting using a casting substrate with a diameter of about 0.91 m made from a copper alloy with a room temperature thermal conductivity of about 0.53 cal/cm sec ° C. The substrate velocity used was 15 m/sec. Casting pressures ranging from 21 kPa to 24 kPa, nozzles with single slots having a width of 0.76 mm and nozzle/substrate gaps of between 0.18 mm and 0.33 mm were used. In these casts, strips ranging in thickness between about 60 μm and 75 μm were produced. Each of the strips was subjected to X-ray diffraction analysis and was determined to be completely amorphous within the limits of the X-ray diffraction technique.

Strips from these casts were cut into 30 cm lengths and then annealed under conditions that are representative of standard conditions for conventionally cast strip of this nominal composition. Core loss measurements were made with a straight strip measurement technique. Room temperature core loss at 60 Hz, 1.4 T of these strips is listed in the Table 2.

TABLE 2

| Strip Number | Strip Thickness | 60 Hz, 1.4 T Core Loss |
|---|---|---|
| 218-1 | 72 μm | 0.17 W/kg |
| 218-2 | 73 μm | 0.19 W/kg |
| 219-1 | 68 μm | 0.17 W/kg |
| 219-2 | 65 μm | 0.17 W/kg |
| 219-3 | 63 μm | 0.17 W/kg |

EXAMPLE 9

An alloy having a nominal composition of 4.6 wt % Si and 2.75 wt % B, the balance being Fe plus incidental impurities, was cast into strips having a width of 142 mm by Planar Flow Casting using casting substrate with a diameter of about 0.60 m made from a copper alloy with a room temperature thermal conductivity of about 0.53 ca/cm sec ° C. The substrate velocity used was about 20 m/sec. Casting pressures ranging from 24 kPa to 28 kPa, a nozzle with a single 0.76 mm wide slot and a nominal nozzle/substrate gap of 0.28 mm were used. Strips ranging in thickness between about 55 μm and 64 μm were produced.

EXAMPLE 10

An alloy having a nominal composition of 4.6 wt % Si and 2.75 wt % B, the balance being Fe plus incidental impurities, was cast into 142 mm wide strip by Planar Flow Casting using a casting substrate having a diameter of about 0.91 m made from a copper alloy having a room temperature thermal conductivity of about 0.53 cal/cm sec ° C. The substrate velocity used was about 20 m/sec. A nozzle with a single 0.76 mm wide slot was used with a nominal nozzle/substrate gap of 0.23 mm. The average thickness of the strip so produced was 53 μm.

Although the present invention has been described above with particular reference to ferromagnetic amorphous metal alloys which are iron based, it will be understood by those skilled in the art that the principles of the invention apply equally as well to other ferromagnetic amorphous alloys, especially those containing major amounts of nickel and/or cobalt. Likewise, ferromagnetic amorphous alloys containing at least one of iron, nickel and cobalt, when processed into thick amorphous alloy strip in accordance with the invention would exhibit improved mechanical and magnetic properties.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. An amorphous metal strip having a sheet thickness ranging from about 50 to 75 μm, a width greater than about 20 mm and a room temperature fracture strain of at least about 0.01, said strip being produced by a single-roll cooling process wherein molten alloy is ejected from a nozzle onto a rapidly moving quench substrate, said single nozzle having a single orifice therein through which said molten alloy is ejected, said quench substrate having a room temperature thermal conductivity greater than 0.5 cal/cm sec ° C., and said quench substrate being a wheel having a diameter greater than 0.5 m.

2. An amorphous metal strip as recited by claim 1, wherein said alloy is ferromagnetic.

3. An amorphous metal strip as recited by claim 2, said strip being iron based and, after annealing, having a core loss at room temperature of less than 0.2 W/kg at 60 Hz and 1.4 T.

4. An amorphous metal as recited by claim 1, wherein said strip has a lamination factor of at least 0.80.

5. An amorphous metal as recited by claim 1, wherein the said strip has a thickness of about 52 μm.

6. A transformer core comprising thick amorphous strip produced from the strip defined by claim 1.

7. A transformer core as recited by claim 6, wherein said core is a stacked core composed of a plurality of laminations of said strip.

8. A transformer core as recited by claim 6, wherein said core is a wound core composed of a plurality of wound laminations of said strip.

* * * * *